United States Patent [19]

Molia

[11] Patent Number: 4,977,387

[45] Date of Patent: Dec. 11, 1990

[54] ADJUSTING POTENTIOMETER FOR ELECTRONIC CIRCUITS, PROCESS FOR ASSEMBLING THE ELEMENTS THEREOF AND PROCESS FOR OBTAINING THE RESISTIVE PLATE THEREOF

[75] Inventor: Emelio C. Molia, Saragossa, Spain

[73] Assignee: Aragonesa de Componentes Pasivos, S.A., Saragossa, Spain

[21] Appl. No.: 323,332

[22] Filed: Mar. 14, 1989

[30] Foreign Application Priority Data

Mar. 21, 1988 [ES] Spain ..... 8800858

[51] Int. Cl.[5] ..... H01C 10/34

[52] U.S. Cl. ..... 338/174; 338/160; 338/161; 29/610.1

[58] Field of Search ..... 338/174, 160, 161, 162, 338/184; 29/610.1

[56] References Cited

U.S. PATENT DOCUMENTS

| | | | |
|---|---|---|---|
| 2,744,986 | 5/1986 | Caldwell | 338/142 X |
| 3,470,519 | 9/1969 | Hatch | 338/162 |
| 3,591,413 | 7/1971 | Seki et al. | 427/103 X |
| 4,792,778 | 12/1988 | Arriazu | 338/174 |

FOREIGN PATENT DOCUMENTS

| | | | |
|---|---|---|---|
| 866341 | 4/1961 | United Kingdom | 338/174 |
| 2100523 | 12/1982 | United Kingdom | 338/174 |

*Primary Examiner*—Bruce A. Reynolds
*Assistant Examiner*—Marvin M. Lateef
*Attorney, Agent, or Firm*—Young & Thompson

[57] ABSTRACT

A potentiometer has a parallelepiped casing provided with recesses for fitting connecting terminals which are secured to the casing by plastically deformed studs projecting outward from the casing. Slots are formed in the casing so that the ends of the terminals may project into the casing and be deformed into contact with a resistive plate within the housing. The collector preferably comprises a plate substantially coextensive with one face of the parallelepiped housing, and which is secured to the housing by deformable flanges formed at its edges. A central hole formed in the housing constitutes a bearing for the rotor-actuated cursor. Assembly of the potentiometer may be performed continuously by assembling the terminals, cursors and collectors on a continuous band. The resistive plate is preferably obtained from an electrically insulating substrate on which a resistive paint is first applied and then a silver glaze, with intermediate drying phases.

10 Claims, 23 Drawing Sheets

FIG.5
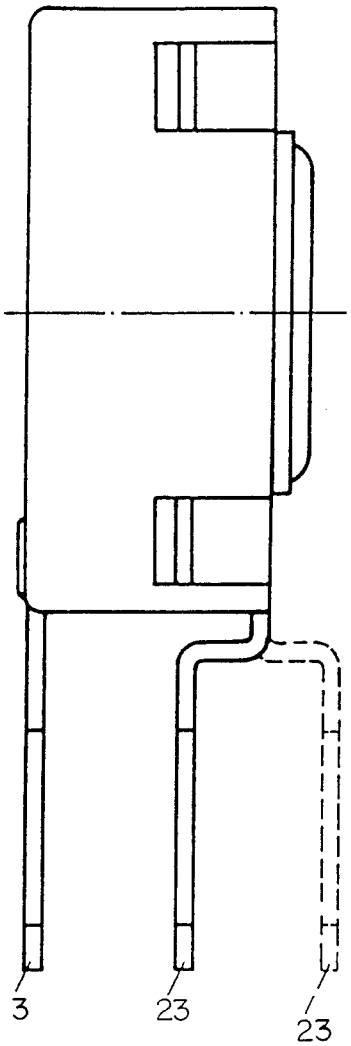
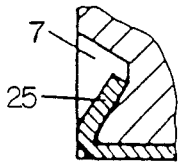
FIG.6
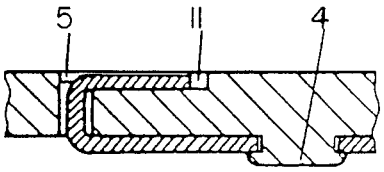
FIG.7
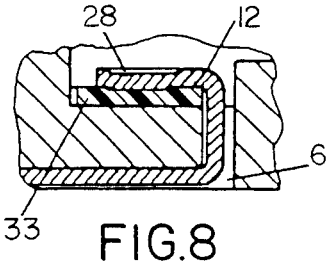
FIG.8

FIG. 14
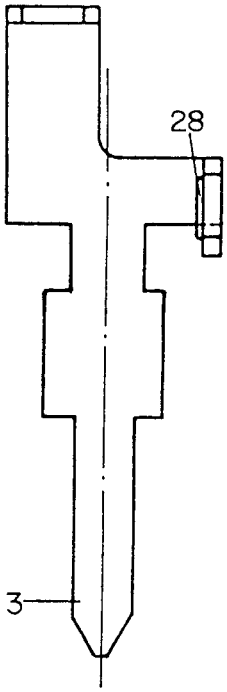
FIG. 15
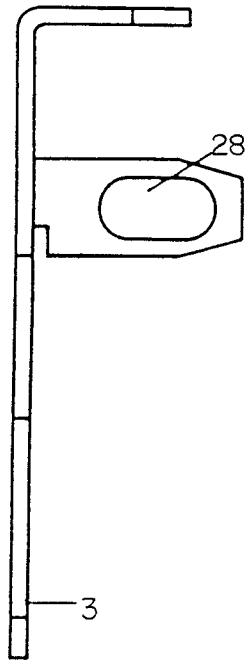
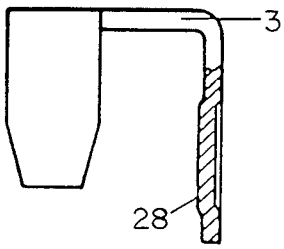
FIG. 16

FIG. 18
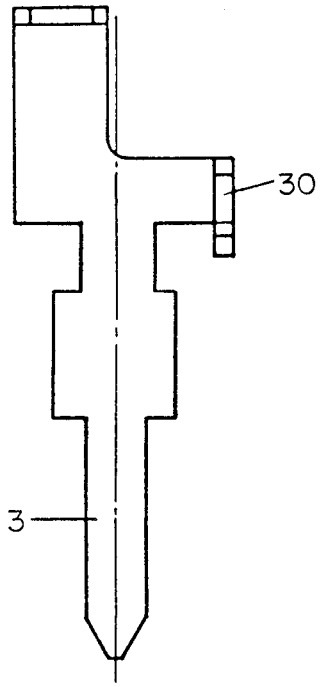
FIG. 19
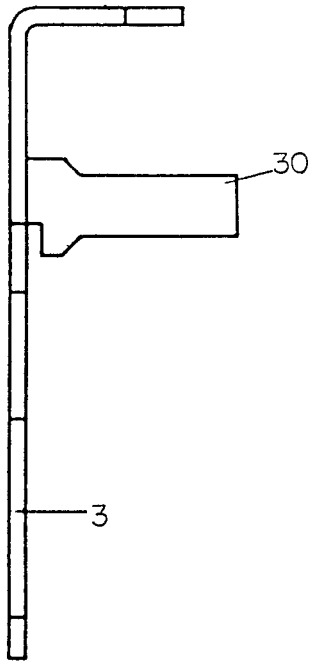
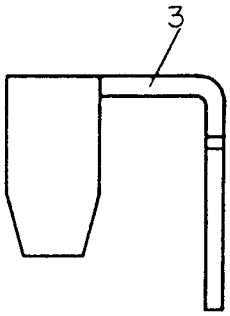
FIG. 20
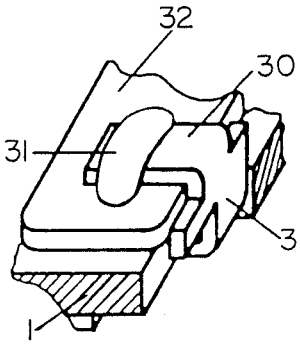
FIG. 17

FIG.21
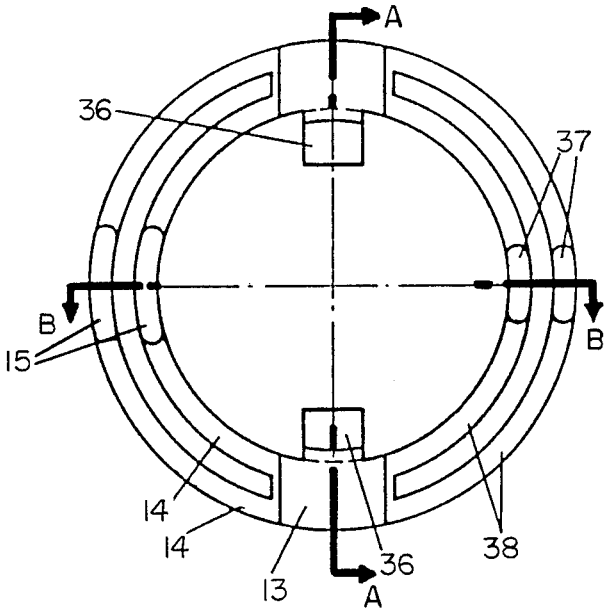
FIG.22
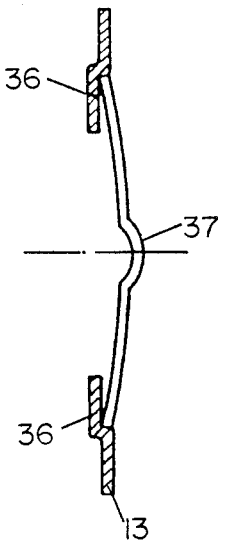
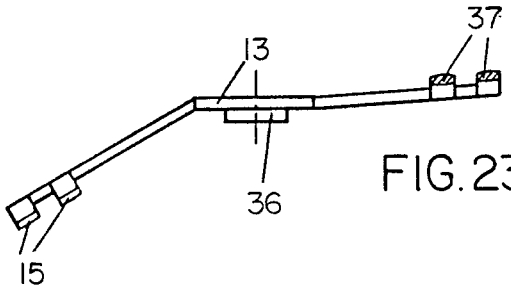
FIG.23

ADJUSTING POTENTIOMETER FOR ELECTRONIC CIRCUITS, PROCESS FOR ASSEMBLING THE ELEMENTS THEREOF AND PROCESS FOR OBTAINING THE RESISTIVE PLATE THEREOF

OBJECT OF THE INVENTION

The present invention relates to a potentiometer of the type commonly known as "adjusting and semicontrol" potentiometers, utilised for electronic applications, potentiometers which, although rather small in size, provide high services.

The invention also refers to the process for assembling the electromechanical elements or components thereof, as well as to the process for obtaining the resistive plate thereof.

BACKGROUND OF THE INVENTION

Conventional potentiometers of the said type are comprised of an electrically insulating body forming a cylindrical cup, inside which is housed the resistive plate which adopts the shape of an open circular ring, which plate is secured at its ends to the said cylindrical cup by means of rivets which simultaneously constitute the means for electrically connecting the said resistive plate to the corresponding connecting terminals. The said cup is closed by the complementary collector of the said resistive plate which, in turn, extends radially into the corresponding connecting terminal. A circular ring shaped cursor, which adapts itself to the inner face of the collector, is hinged to an axis of rotation, it is provided with an inclined arem and ends in a projection by means of which it contacts any point of the resistive plate, when the said axis is made to rotate. The said axis is provided at least one of its ends with means enabling any appropriate tool, such as for example a screwdriver, to operate it.

The problems derived from this structure are multiple and varied.

Its cylindrical configuration impedes handling thereof, specifically insofar as its correct positioning with repect to the printed circuit wafer in which it ought to be mounted, when the said assembly takes place automatically.

The angle of rotation of the cursor, which could theroetically be brought markedly closer to the complete turn, is reduced to a value close to 235°.

The collector offers a rather small thermal dissipational surface, which negatively affects operation of the potentiometer, and distortions may even be produced therein.

The roughnesses produced in the collector from the cutting operation to obtain the central hole, cause an irregular turning torque.

The plastic flanging for securing the collector to the caisng offers a poor axial thrust resistance on the rotor or cursor.

The control of the turning torque of the rotor and the cursor on the resistive plate is difficult and irregular.

The part of the terminals which are coupled to the printed circuit, is short, obstructing insertion when the terminals have a greater thickness, as also, obviously, the subsequent welding thereof. Supplementarily, and since they are closer to the heating zones, the plastic parts of the component experience deformations during the welding process, which may alter the continuity of the electrical contacts.

With the present clamping system for securing the resistive plate to a surface difficult to control, since this relates to another pre-bent mechanical staple with the logical material recoveries, losses in contact are produced between the terminal and the resistive plate, in the event of a lack of pressure when bending the leg surrounding the resistive plate, whilst in the event of an overpressure, breakage of the said plate may be produced.

The system for clamping the terminals of the casing and the resistive plate causes, at the time of welding thereof to the circuit, when welding takes place manually, by heat radiation and specially due to the fact that the thermal level during manual heating is difficult to control, the plastic materials to become soft, therefore producing intermittent losses in the electric continuity.

DESCRIPTION OF THE INVENTION

The potentiometer of the invention, whether of the "carbon" or the "cermet" type, overcomes the aforesaid problems satisfactorily, whilst proportioning supplementary advantages.

Therefore, and more specifically, the resistive element is formed of agglomerated metal and ore loads, having a resistive action to the electric current, deposited on a dielectric which acts as the substrate.

In both cases, the ends of the resistive film are joined to metallic terminals which conduct electricity as far as the exterior of the potentiometer.

This further incorporates a flexible, metallic driving member capable of slidingly by brushing the resistive film, denominated cursor, whereby the resistive plate contacts the collector electrically, consisting of a static metal element which, in turn, has a metal appendix also acting as an electric terminal towards the exterior of the component.

Based on these metallic terminals joined to the resistive film and to the collector, the potentiometer may be implanted in printed circuit plates.

The outer appearance of the potentiometer adopts the configuration of a parallelepiped case or casing from which three metallic terminals or pieces emerge, which project in the proper length and shape to be joined to or inserted in electronic circuits, for which purpose they are provided, at their ends furthermost from the casing, with shapes or deformations permitting the maximum ease and security in the joining.

The potentiometer incorporates an axial opening occupied by an electrically insulating element, the adjusting rotor, which permits rotating movements jointly with the said cursor and which, at its end directly accessible from the outside, is configured so as to enable different operating tools, such as for example a slot for a screwdriver, a hexagonal recess for an allen screw, etc., to be coupled.

The connecting legs or terminals thereof could adopt various positions, depending on the different assemblies contemplated in an electronic circuit.

The briefly described structure has been designed for an automatic mounting to its components by means of transfer, linear, and high cycle-type machines.

In accordance with another aspect of the invention, the process for assembling the potentiometer itself is conducted utilising the said machines, by means of electric and pneumatic drives, the said machines being controlled by a microprocessor which will control the operating sequence thereof, as well as all the parameters fixed for checking the product in the final phase.

The process is carried out on metal bands previously stamped for obtaining the collectors, terminals and cursors which, in turn, serve as a support for the plastic pieces automatically fed throughout the entire process of assembly.

The invention also relates to the process for obtaining the resistive plate, which constitutes a further aspect of the invention. This process consists in the application of one or more conductive resistive pastes, physiochemically adhered to a flexible plastic support previously cut into bands having a suitable width, the main feature of which is centered on the fact that application takes place continuously.

DESCRIPTION OF THE DRAWINGS

FIGS. 4 and 5 illustrate respective possibilities or alternatives for housing the connecting terminals in the potentiometer.

FIG. 6 illustrates a sectional detail of the system for securing the collector to the chasing.

FIG. 7 illustrates another sectional detail corresponding to the clamping and riveting of each terminal to the casing.

FIG. 8 illustrates another sectional detail of the mutual clamping between the resistive plate, the casing and the terminal.

FIGS. 14, 15 and 16 illustrate, respectively, an elevational, a profile and a plan view of one of the connecting terminals incorporated in the said potentiometer.

FIG. 17 illustrates a perspective detail of the joining of a connecting terminal to the resistive plate, when the said resistive plate is of the "cermet" type.

FIGS. 18, 19 and 20 illustrate an elevational, a profile and a plan view of the type of connector used in the case shown in FIG. 17.

FIGS. 21, 22 and 23 illustrate, respectively, elevational and sectional views of the cursor, in which FIG. 22 is a section along the line A—A of FIG. 21 and FIG. 23 is a section along the line B—B of FIG. 21.

PREFERRED EMBODIMENT OF THE INVENTION

Figure 1:
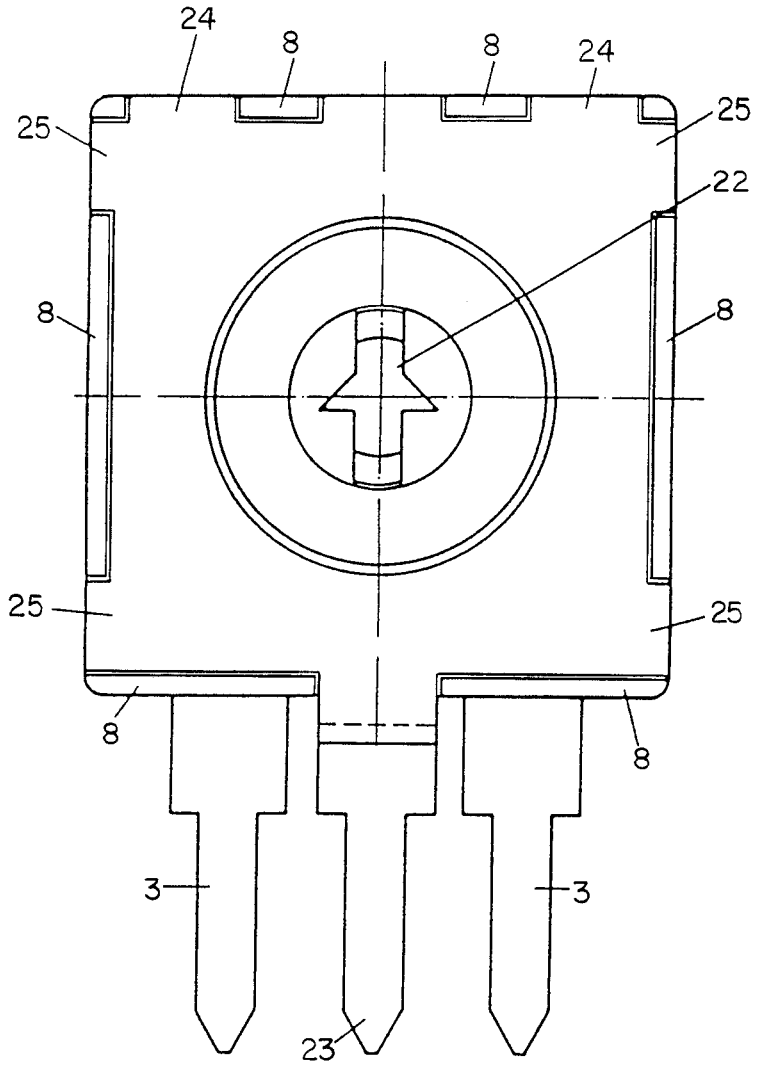
FIG. 1 illustrates an upper view of an adjusting potentiometer for electronic circuit according to the present invention.

Referring to the drawings, it can be seen that the adjusting potentiometer for electronic circuits of the invention is comprised of a casing or case 1 having a parallelepiped configuration and a quadrangular plan and is provided with the dimensions necessary and sufficient for housing the operative elements of the potentiometer. The structural materials of the casing are comprised of charged polymers having a high dielectric strength which insure the thermal, mechanical and chemical stability thereof.

The casing 1 is provided with recesses 2 for the joining and positioning of terminals 3, which joining is carried out with the help of rectangular-shaped studs 4 which, on the one hand, serve to automatically position and feed the casing in question during the process of assembly, which will subsequently be described, and on the other, by plastic deformation as can be seen specially in the detail of FIG. 7, to insure joining of the terminals.

Besides, the casing 1 is provided with holes for the inserition of the terminals, specifically two holes 5 for securing the terminals 3 to the case, and two more, referenced 6, for the subsequent joining to the resistive plate 33, as can be seen in FIGS. 7 and 8, respectively.

Figure 9:
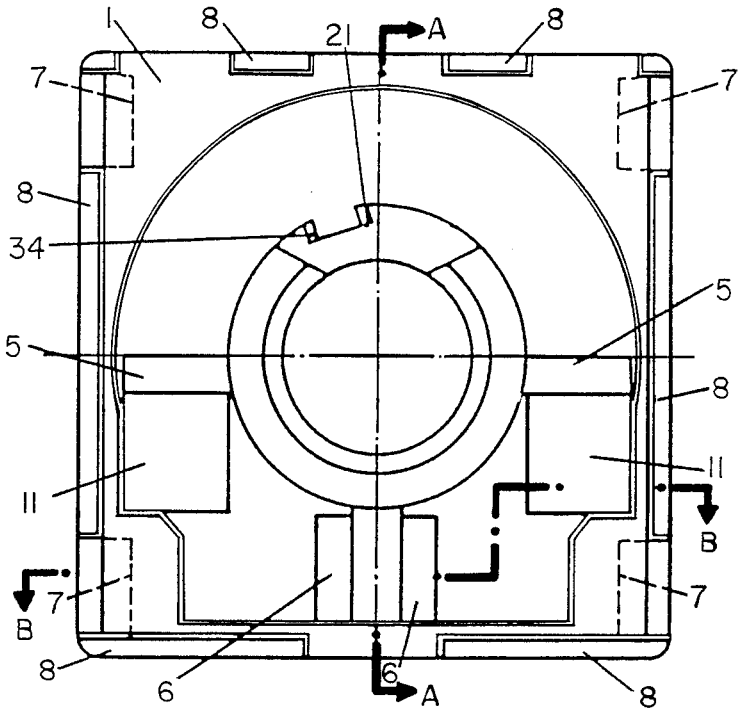
FIG. 9 illustrates a plan view of the potentiometer casing.
Figure 12:
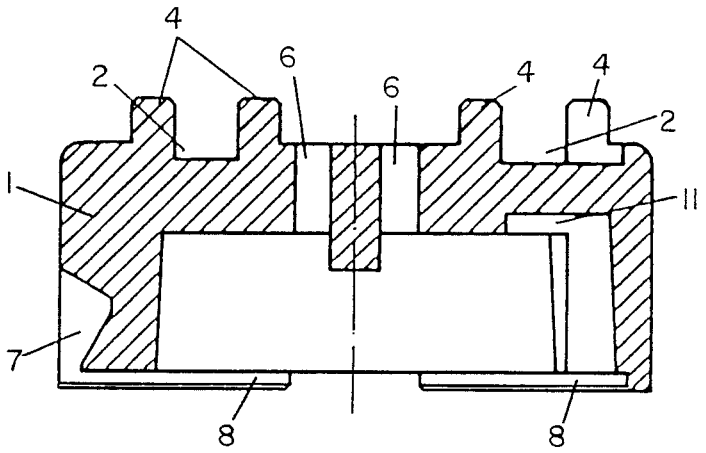
FIG. 12 illustrates another cross-sectional view of the casing, taken along the line B—B of FIG. 9.

The casing 1 is provide on its sides with recesses 7, shown in turn in FIGS. 9 and 12, for clamping the collector to the casing, as can be seen in turn in FIG. 6.

It is also provided with indentations 8 for the correct positioning of the collector.

It incorporates, at one of its bases, a dial 18 which, jointly with an arrow established in the rotor, enables the position at which the cursor is encountered on the resistive strip, to be clearly indentified. This cursor, obviously, encloses the coupling hole of the rotor, a wide-mouthed entrance hole 19, to facilitates assembly of the said rotor.

Figure 13:
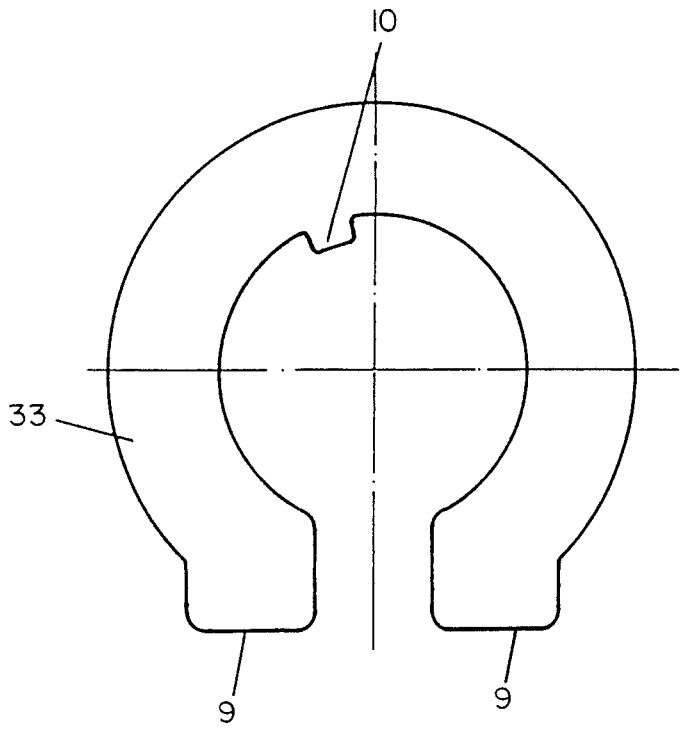
FIG. 13 illustrates a plan view of the resistive plate.
Figure 24:
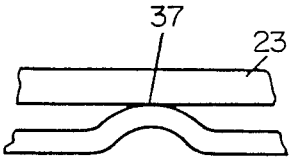
FIGS. 24 and 25, on the one hand, and FIGS. 26 and 27, on the other, illustrate respective detail of the contact between the cursor and the collector and between the said cursor and the resistive plate.
Figure 25:
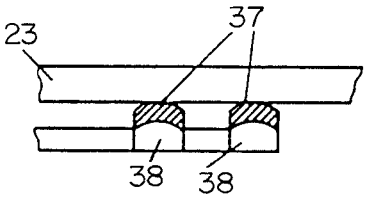
Figure 26:
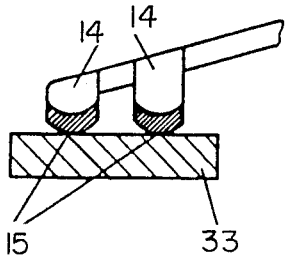
Figure 27:
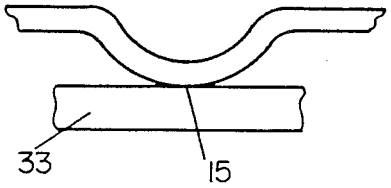
Figure 28:
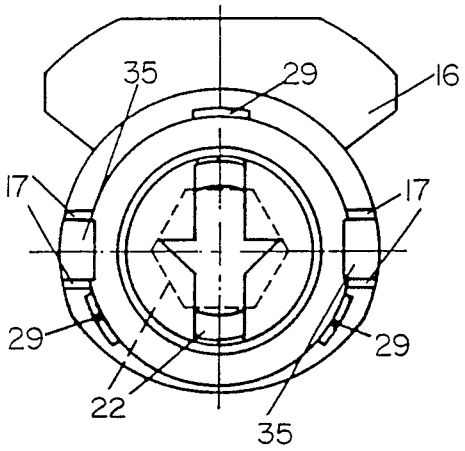
FIGS. 28 and 29 illustrate respective axial views of the rotor.
Figure 31:
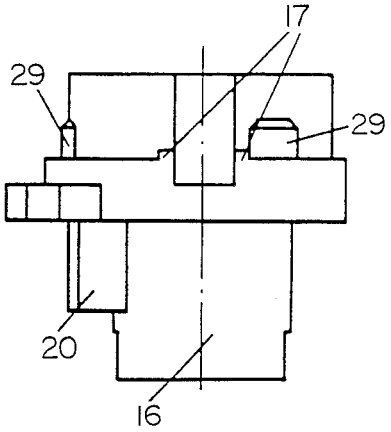
FIGS. 30 and 31 illustrate the said rotor, the former is a sectional view and the latter a side elevational view.
Figure 29:
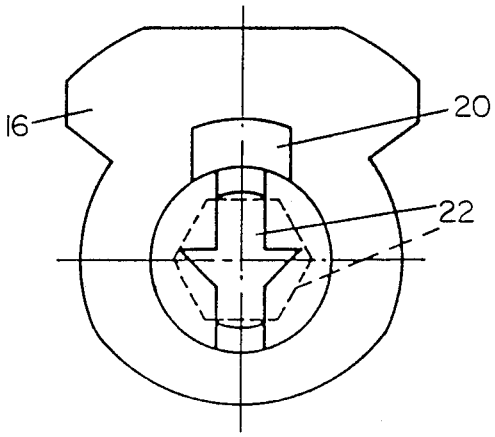
Figure 30:
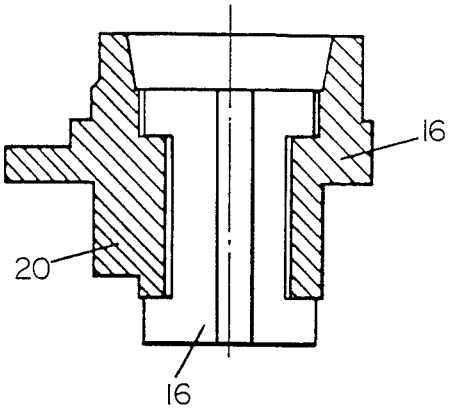
Figure 32:
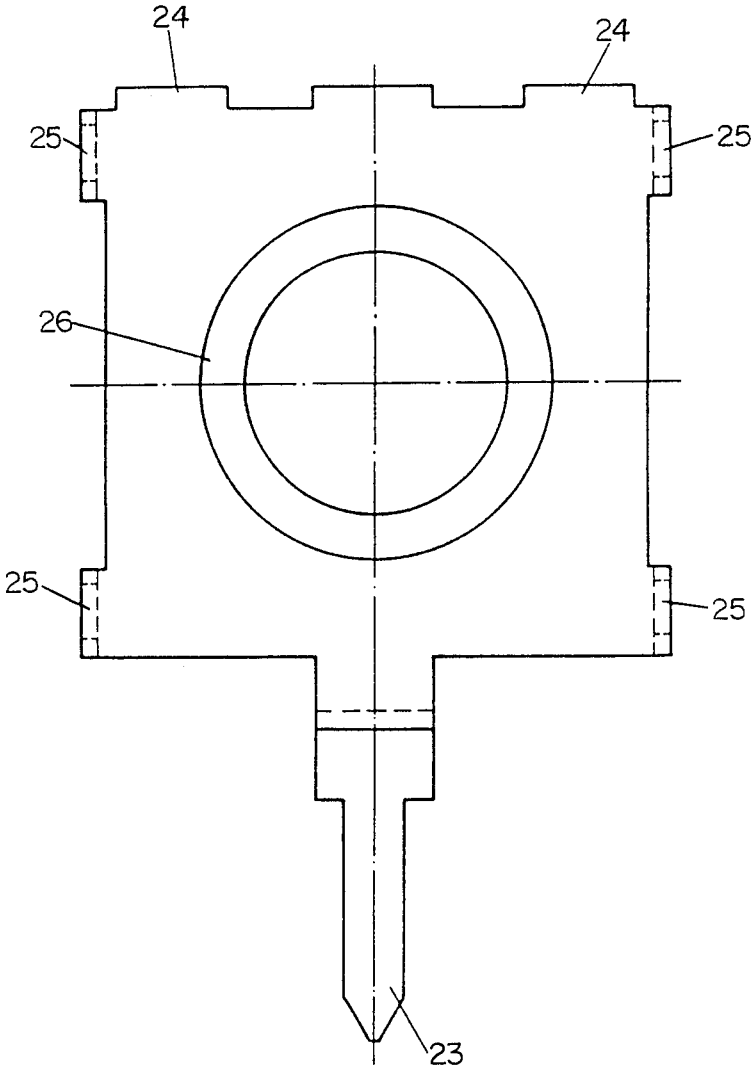
FIGS. 32 and 33 illustrate, respectively, an elevational and a profile view of the collector.
Figure 33:
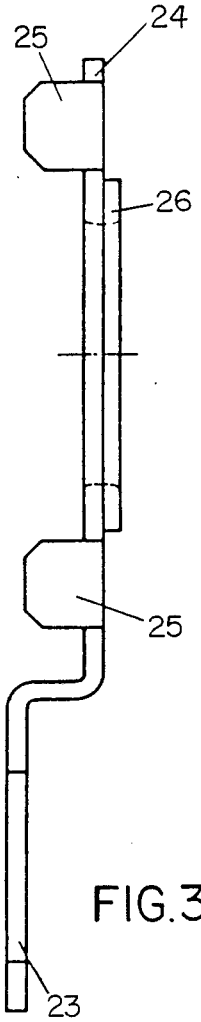
Figure 34:
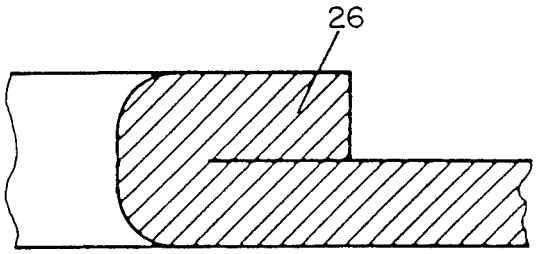
FIG. 34 illustrates a sectional detail of the flanging of the central opening of the collector, which guarantees the proper sliding of the rotor.

The resistive plate 33, illustrated in detail in FIG. 13, is fixed to the bottom of the casing 1, which plate is comprised of various agglomerated metal and ore loads, depending on whether the potentiometers are of the carbon or cermet type, a plate consisting of a resistive film deposited on an insulating substrate, such as plastic, phenolic papers, ceramics or the like and which, as a whole, constitute the said resistive plate.

The resistive plate has the shape of an open circular ring with flat endings 9, enabling it to be positioned in the casing 1, and an inwardly oriented radial projection 10 in the form of a key with rounded edges for facilitating its automatic positioning, to which projection will be riveted, by plastic deformation, the indentations 34 of the casing 1, thus insuring a perfect joining of the resistive plate 33 of the casing.

The surface of the resistive film may include one or more areas having different electric conductivities.

Reverting again to the terminals 3, these terminals could be of iron, brass or copper alloys, totally or partially coated with nickel, tin or tin-lead alloys. The said terminals present themselves in the casing 1 through the holes 5 of the casing and are clamped therein by the deformed studs 4 as shown in the detail of FIG. 7, housed in the corresponding slots 11 of the casing. Furthermore, they are also clamped, with electrical contact, to the resistive plate 33 itself, as can be seen in detail 12 of FIG. 8. The imaginary axes corresponding to the said clampings are perpendicular to each other, a fact which permits a higher heat dissipation at the time of assembly to the electronic circuit, thereby preventing plastic deformations of the casing 1 and insuring the electrical contact, since it remains stable and unaltered in the said assembly in which, as previously mentioned, the terminal, the casing and the resistive plate intervene.

It should also be emphasised that the part of the terminal 3 which is clamped to the resistive plate 33 has a deformation or countersunk 28, clearly visible in FIG. 16, which insures the electrical contact according to detail 28 of FIG. 8. The terminals will be secured to the casing by plastic deformation of the pivots 4 and will be housed exteriorly, as illustrated in the view of the assembly of FIG. 3, in a cavity 2 of the casing, which anatomically adapts itself to the perimeter of the terminal at this joining zone thereof.

When the resistive element of the potentiometer is of the cermet or carbon type, which involves a ceramic substrate as that represented in FIG. 17 and referenced 32, the terminal will present slight modifications, in accordance with the representation of FIGS. 18 to 20, ending specifically in a tapering 30 which rests on the end of the resistive element according to the detail of FIG. 17. In this case the joining between this part of the terminal and the area corresponding to the resistive element takes place with the help of an electric conveying polymer or an electric conveying thermal cutout cement 31.

The cursor, illustrated in detail in FIGS. 21 to 23, consists of an element made of metal, brass, bronze or other alloys, and is designed to electrically bridge the resistive plate 33 and the collector 23. Its constitution and shape confer thereto a flexible action when supported on the resistive plate 33 in a variable range of from 30 to 250 grams-force.

This cursor 13, when supported on the resistive plate 33, determines a dual contact 14, with rivet snap 15 and a half round-shaped contact tile 14, in order to facilitate contact and to prevent the ribbings and ragged edges, typical of a cutting operation, from scratching the resistive strip.

On the contrary and similarly, it makes an electrical contact with the collector 23, by means of a dual contact 38, with rivet snap and half round-shaped contact tile 37, in order to facilitate contact and to also prevent the ribbings and ragged edges, typical of a cutting operation, from scratching the collector.

This cursor 13 turns jointly with a rotor 16, thanks to the key-like adjustment defined by indentations 36 of the cursor which fit into homologous cavities 35 of the rotor which, subsequently and by plastic deformation of projections 17 of the rotor, is riveted guaranteeing a perfect joining, in such a manner that it could be positioned from the outside on any area of the resistive strip by a rotating movement.

The rotor 16 may be of thermoplastic polymers or of any other material having a high dielectric strength.

Its turn is limited to a certain angle by a butt 20 operatively established therein and complementary of another butt 21 existing in the casing 1.

The rotor could be turned with any suitable tool towards its central recess 22, which recess could be rectangular or it could adopt any other geometry. To this recess 22 could be coupled, in a fixed manner, other pieces, such as pins or knobs, in order to facilitate movement thereof, in accordance with the practical requirements of each case.

Finally, the collector 23 will be obtained from the same materials and with the same coatings indicated for the terminals 3 and it will be provided, at its edges, with projections 24 which facilitate the automatic process of assembling it. Specifically, it is secured to the casing by means of four clamp-like stamped arms 25 complementary to the cavities 7 provided in the casing 1 and according to the detail of FIG. 6.

Its position within the casing is guaranteed by the indentations 8 of this latter.

It incorporates a flanged central hole 26 which guarantees the uniform and regular sliding of the rotor 16, serving as a guide bearing therefor.

Figure 2:
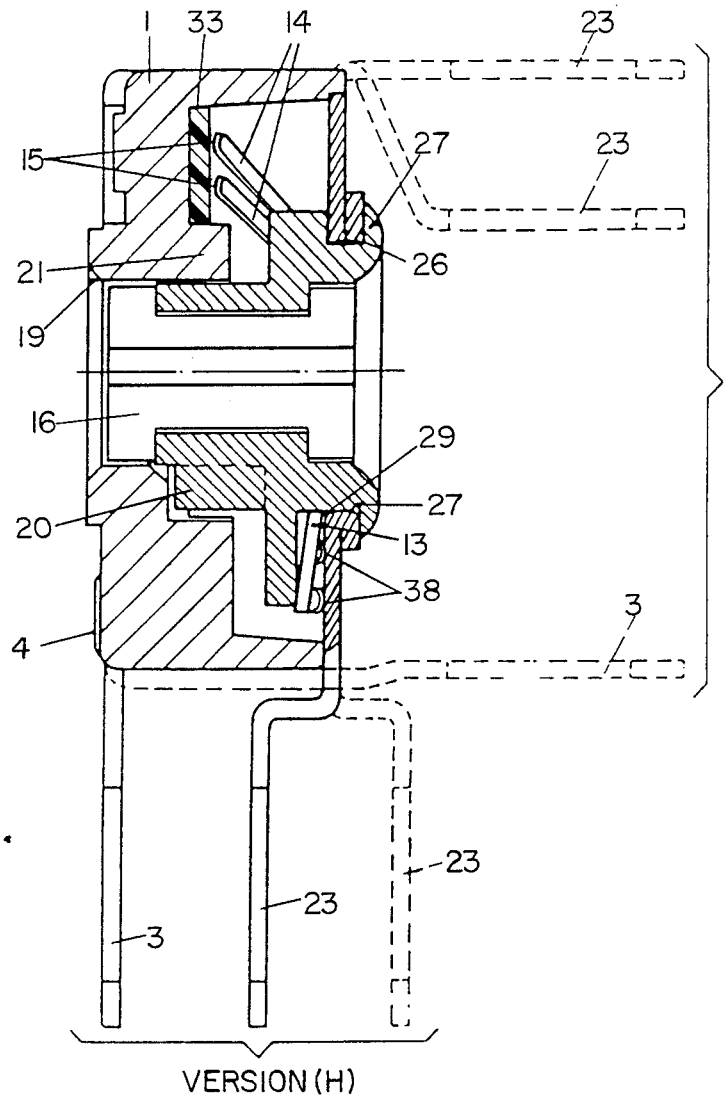
FIG. 2 illustrates a side elevation sectional view.

The outer edge of the rotor 16 is folded by plastic deformation, as can clearly be seen in FIG. 2, in which the said folded edge is referenced 27.

The rotor incorporates three indentations 29 which, by overpressure in the collector flanging, guarantee a regular and uniform turning torque, whilst insuring the firm and static position of the contact of the cursor on the resistive element and the collector itself. Due to its shape, it is provided with a large surface which contributes to a higher thermal dissipation in its operation within the electronic circuits.

Figure 35:
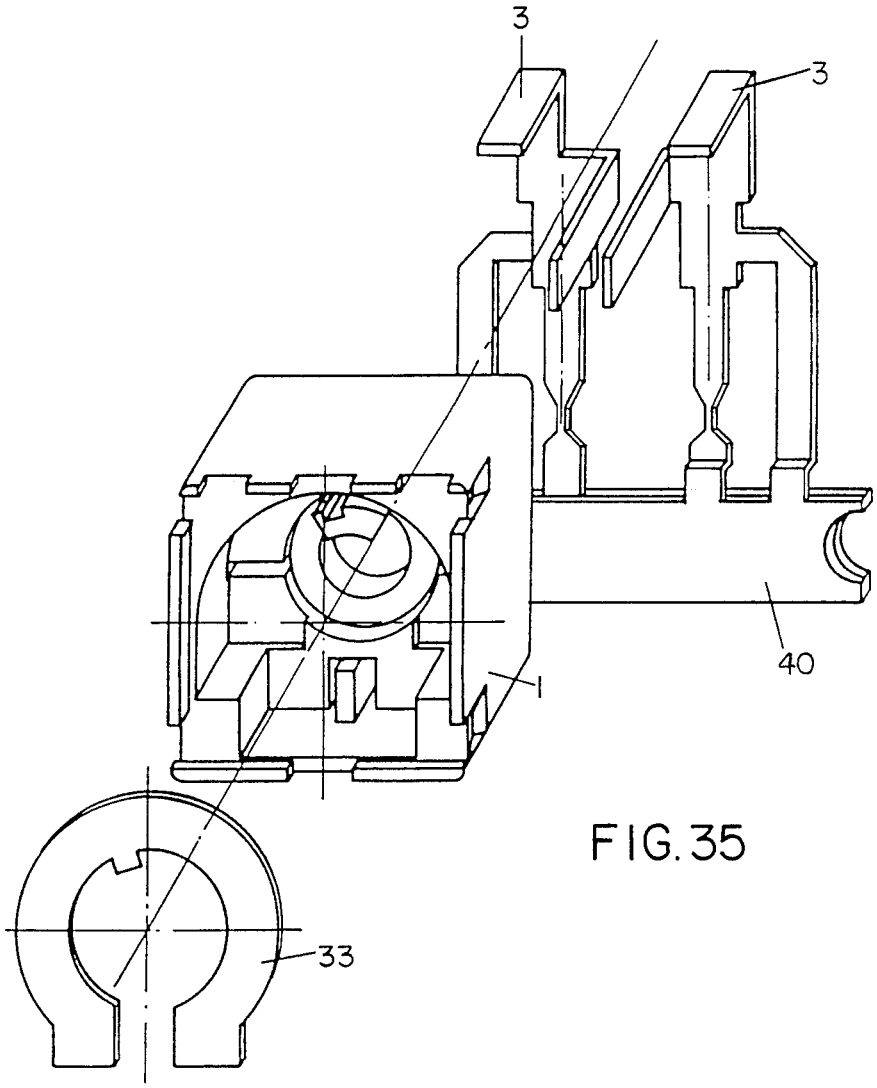
FIG. 35 illustrates a perspective, exploded view of the contact terminals corresponding to the resistive plate, of the casing and of the resistive plate itself, during the assembly phase between these elements.
Figure 36:
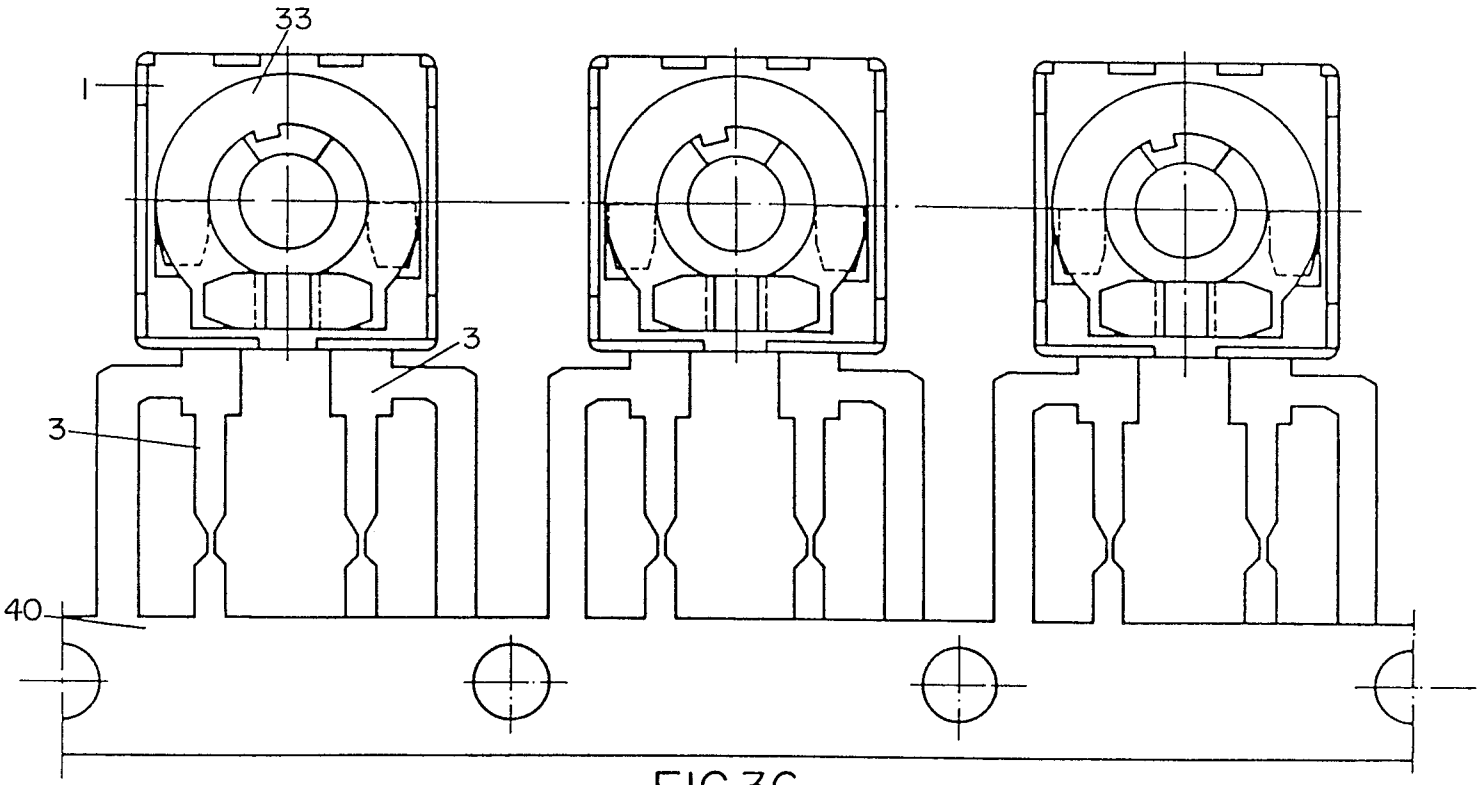
FIG. 36 illustrates the unit of the preceding figure, duly assembled and forming part of a continuous line.

The process for assembling the described pieces or elements is clearly represented in FIGS. 35 to 40, and in accordance therewith it departs from a support band 40 on which, continuously, the terminals 3 are duly stamped, in such a manner that in a first machine each resistive plate 33 is incorporated to each casing 1 and each casing 1, in turn, is coupled to the bent arms of the pair of corresponding terminals of the continuous support band of the said terminals, in accordance with the facing position illustrated in FIG. 35 and up to the definite assembling position illustrated in FIG. 36. Simultaneously in this operation, the two legs of the terminal are clamped according to the details of FIGS. 7 and 8.

Figure 37:
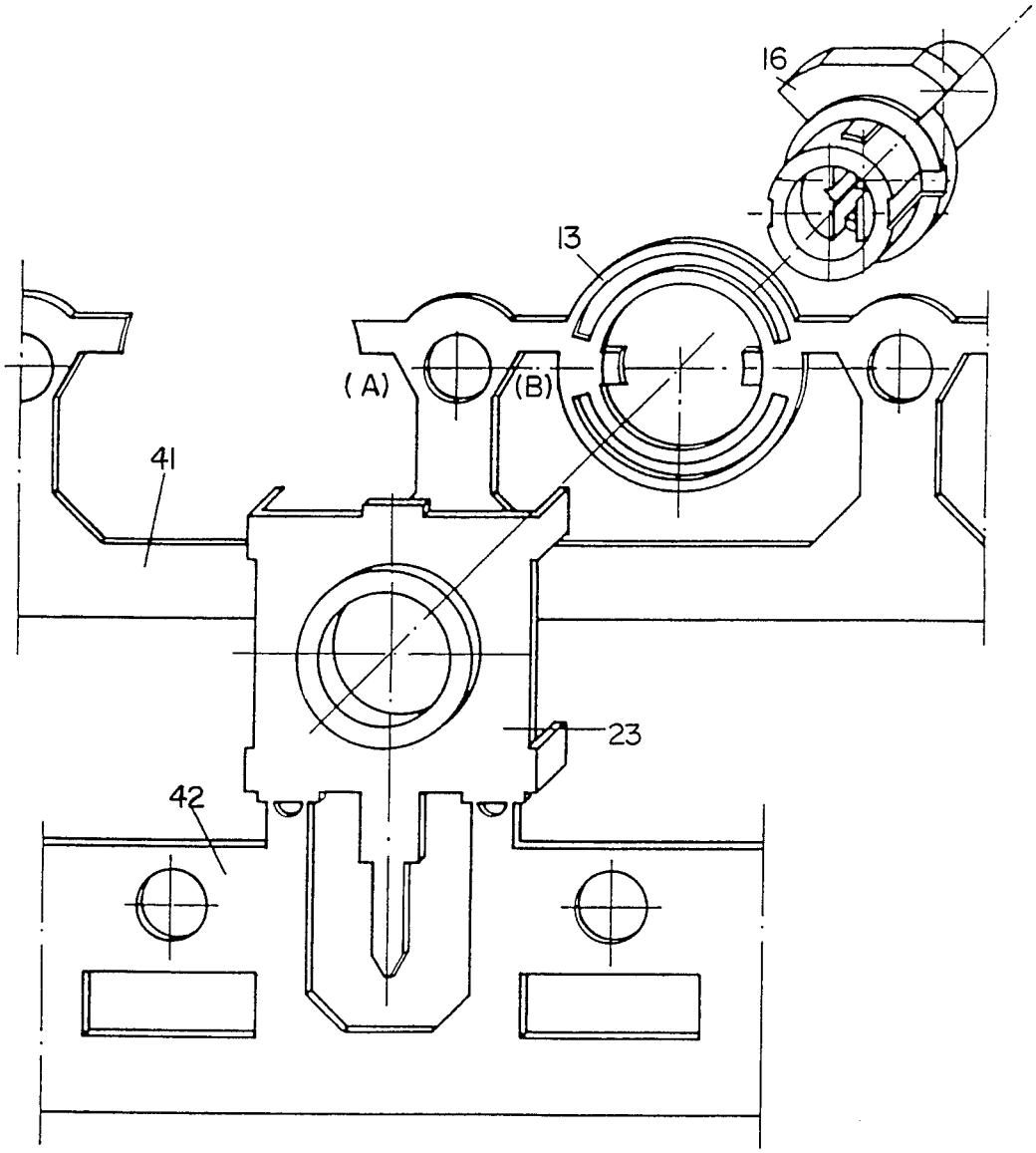
FIG. 37 illustrates, according to a representation similar to that of FIG. 35, a perspective, exploded view of the shaft or rotor, of the cursor also forming part of a continuous band, and of the collector also forming part of a continuous band.
Figure 38:
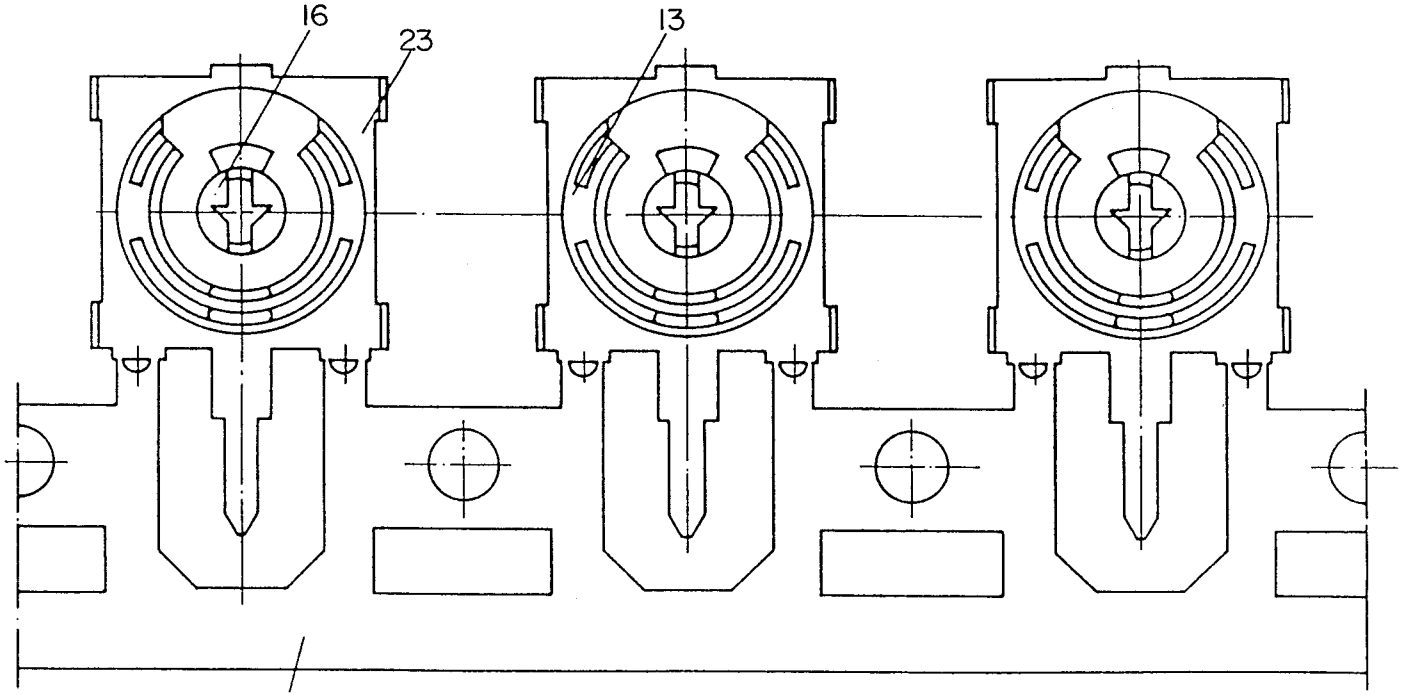
FIG. 38 illustrates the unit of the preceding figure, duly assembled.
Figure 39A:
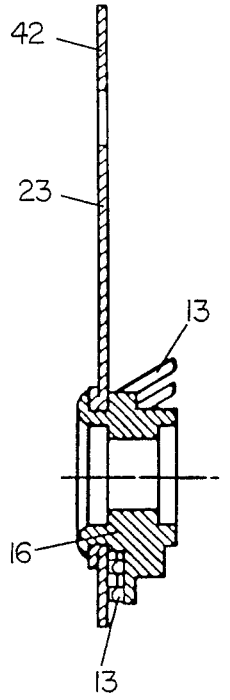
FIG. 39 illustrates a profile view of the pre-assemblies shown in FIGS. 36 and 38, duly faced for their definite assembly.
Figure 39B:
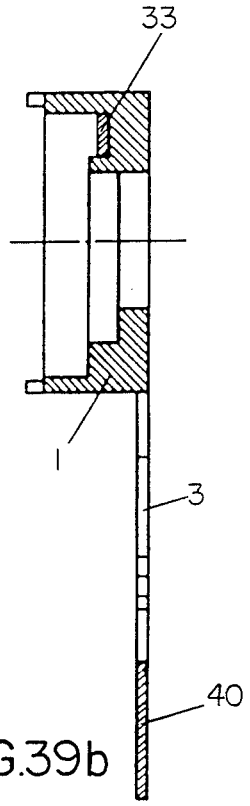

Then, analogously and independently, the cursors 13 which also form part of a continuous band 41, the rotors 16 and the collectors 23, which also form part of a continuous band 42, are proceeded with, carrying out a process of assembly similar to the former and in accordance with the representation of FIGS. 37 and 38. More specifically, in this second machine the first operation consists in mounting the cursor 13 on the rotor 16, within a housing incorporated in the said rotor, whereafter the surplus sector of the said band, which is collected as waste, is cut off as in the former case. The rotor-cursor subassembly is then joined to the collector 23 by plastic deformation of the rotor head.

Figure 11:
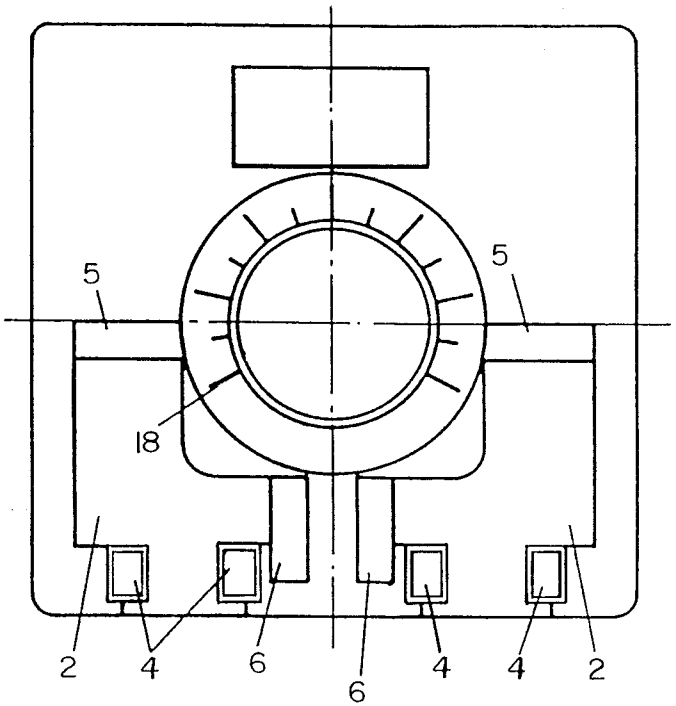
FIG. 11 illustrates another plan view of the casing face opposite that shown in FIG. 9.
Figure 10:
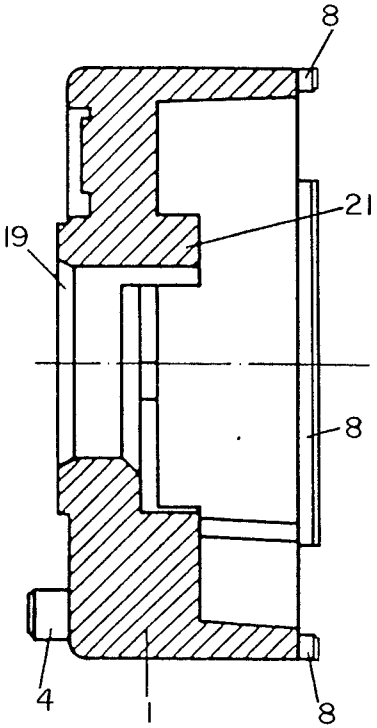
FIG. 10 illustrates a section taken along the line A—A of FIG. 9.

Once the casing-terminal-resistive plate subassemblies, on the one hand, and the rotor-cursor-collector subassemblies, on the other hand, have been obtained, these two subassemblies, in accordance with the representation of FIGS. 10 and 11, are definitely secured together, but maintaining a continuous manufacturing line, at the expense of the band 40 corresponding to the terminals for the first subassembly, and of band 42 corresponding to the collectors 23 for the second subassembly.

Figure 40:
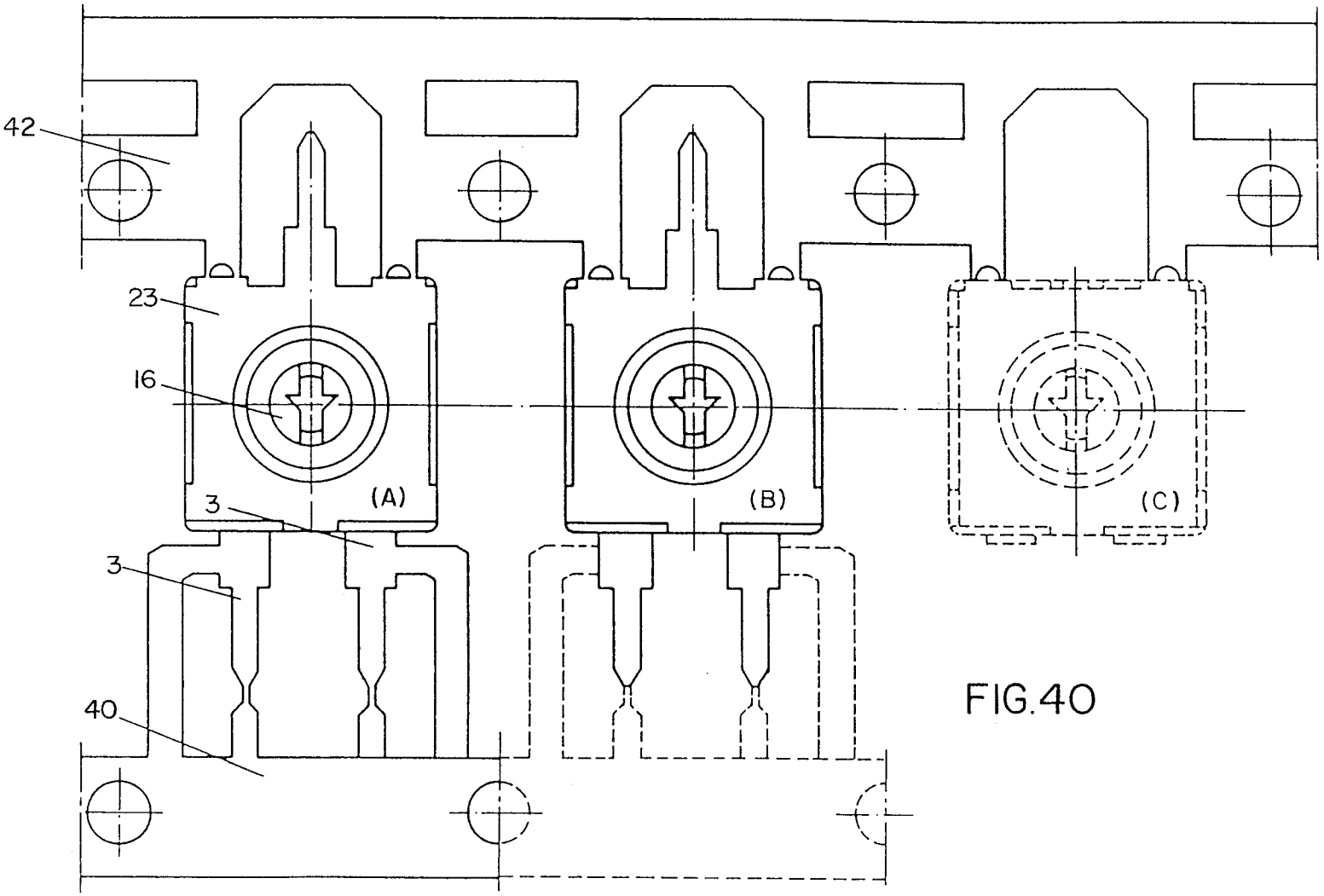
FIG. 40 illustrates a front elevational view of the unit of the preceding figure, duly assembled and always within the continuous manufacturing line.
Figure 43:
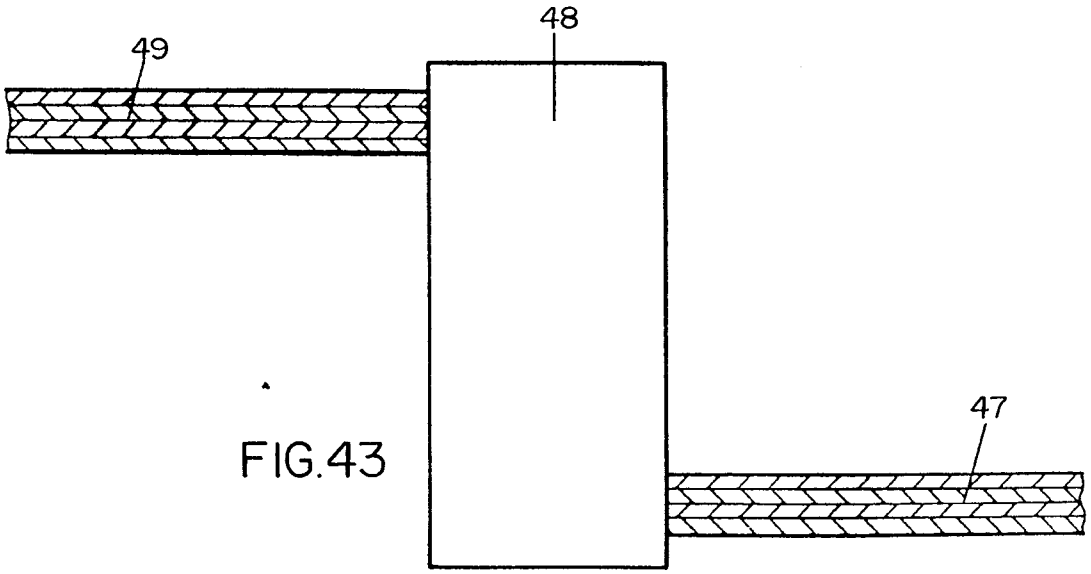

Finally, the remnants corresponding to these two bands 40 and 42 are eliminated and the terminals are folded, as can be seen in FIG. 40, whereby the potentiometers are totally finished and physically independent of one another.

In the folding of the terminals, these terminals would have adopted the most suitable orientation in accordance with the specific application of the potentiometer, finally proceeding with the automatic selection or quality control of the potentiometers, whereby the process is concluded.

Figure 41:
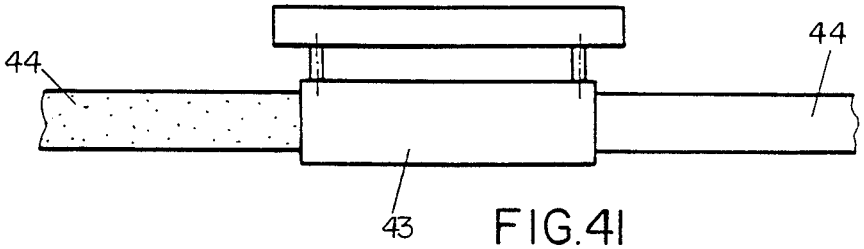
FIGS. 41, 42, 43, 44, 45 and 46 illustrate, finally, the successive operative phases of the process for obtaining the resistive plate.

Finally, and referring to the process for obtaining the resistive plate 33, in a first activating station 43, as illustrated in FIG. 41, a physical-chemical affinity is provoked between the plastic band 44 and a resistive paint to be deposited. This can be achieved by utilising an electric discharge on the plastic, which produces an activation of the functional molecular groups of the former, or by means of a special acid treatment which leads to the same results. These actions involve the production of microcavities which enable the physical fixing or adherence, by roughness, of the resistive pastes applied.

Figure 42:
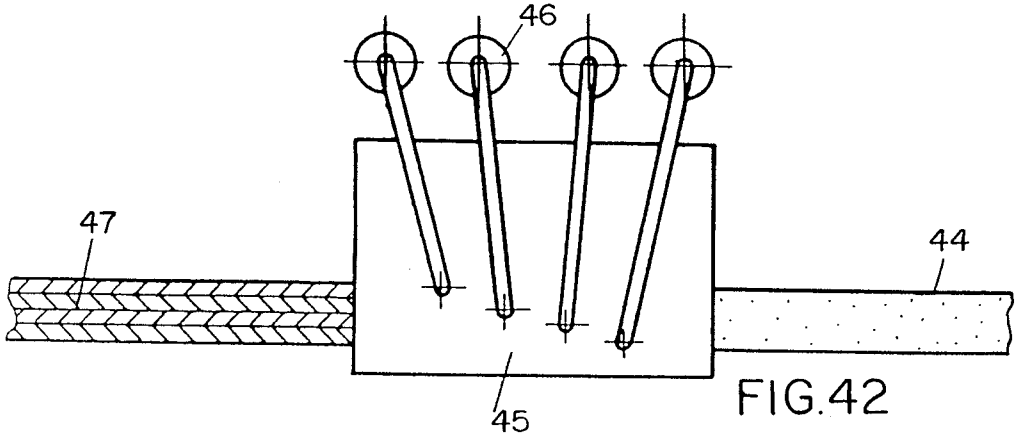

In any case an activated plastic band is obtained, which is then subjected to a painting operation, in accordance with FIG. 42, by introducing the activated band through the lower part of an instrument set with different gauges 45 disposed horizontally and vertically, thereby enabling the resistive paints to be introduced by means of a system of injectors 46 coupled at different areas of the said instrument. This assembly enables various resistive pastes to be simultaneously deposited, synchronously with the passing speed of the band and with a perfect thickness control, on the plastic band 44, the different areas being perfectly defined in the longitudinal and transversal direction of the band, as can be seen in the said FIG. 42 in which the band has been referenced 47 at its outlet from the instrument.

Figure 3:
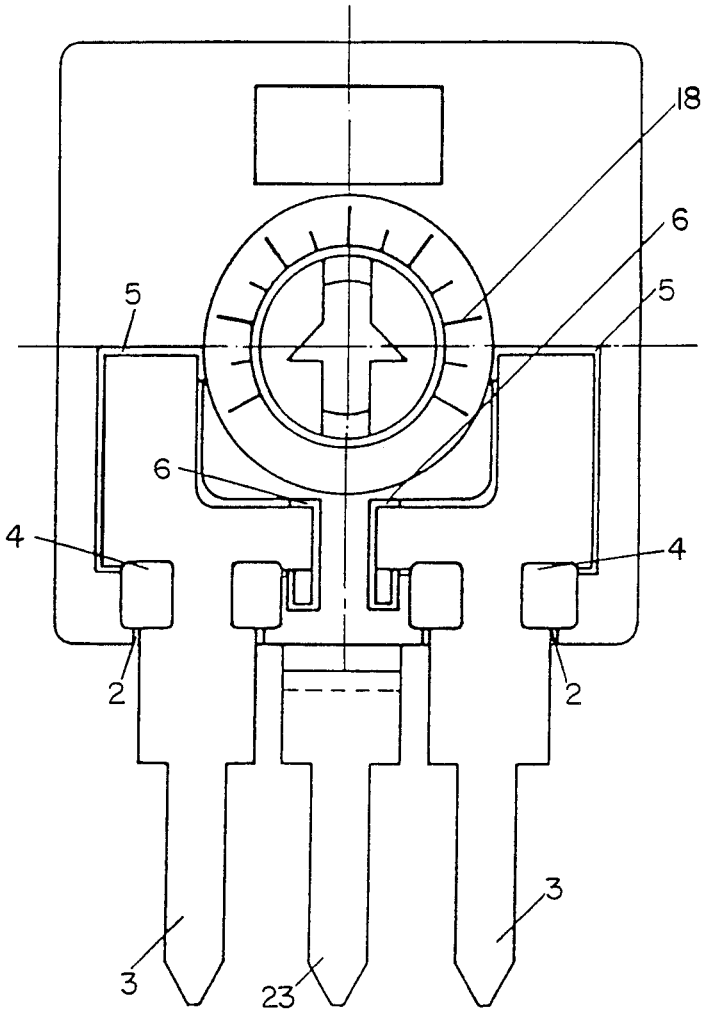
FIG. 3 illustrates a plan view.
Figure 4:
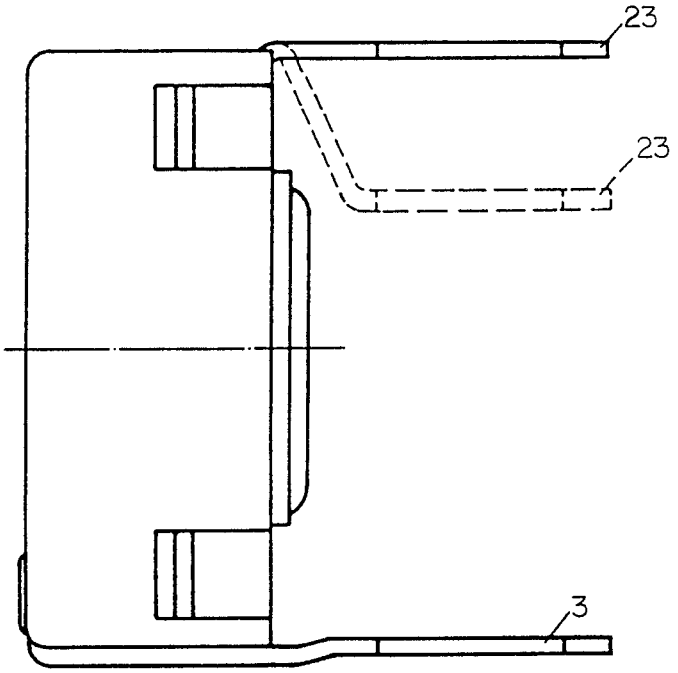

Then the moist painted band 47 is continuously introduced in a drying and curing furnace 48, as illustrated in FIG. 3, in which the applied resistive paste is polymerised and, consequently, a "cured" band 49 is obtained.

Figure 44:
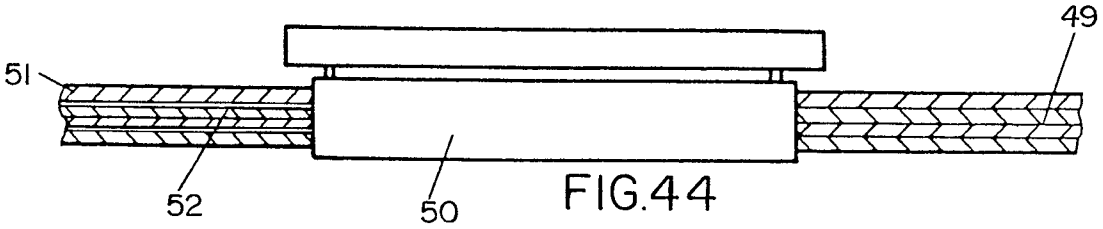

The band 49 is then subjected to the action of a roller mechanism 50, as illustrated in FIG. 44, for the application of silver glaze, which device 50 may paint narrow bands strategically positioned in the longitudinal direction of the band. This process is also continuous and results in the obtention of a plastic band with a cured resistive paste 51 provided with layers of moist silver 52.

Figure 45:
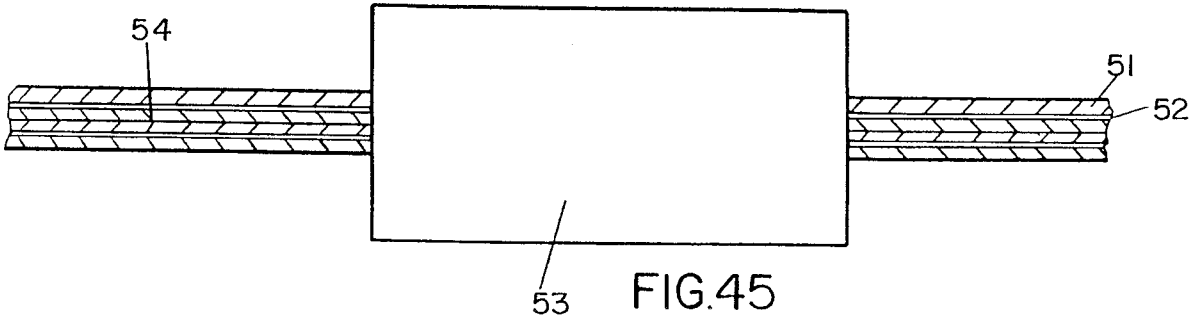

The band 51–52 is then subjected to the effects of a curing furnace 53, as illustrated in FIG. 45, to polymerise the deposited silver glaze 52, obtaining a plastic band 54 with cured resistive paste and silver.

Figure 46:
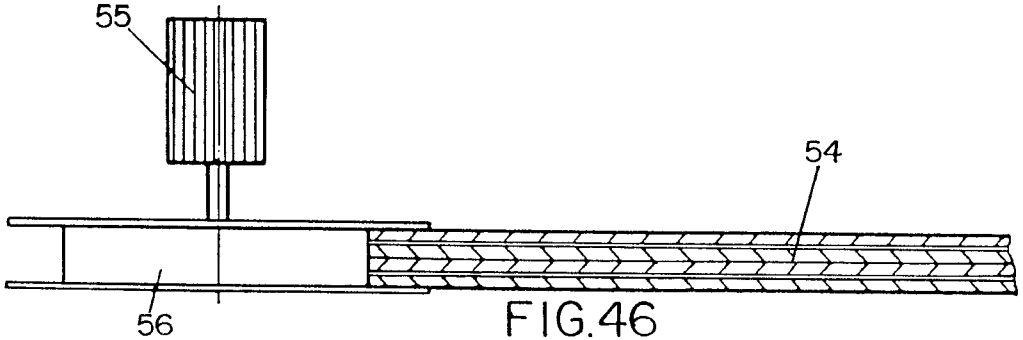

Once all these operations have been conducted continuously, as illustrated in FIG. 46, the band 54 is wound in the form of a coil with the help of a winding machine 55 to which the corresponding wound coil 56 is joined, the band being in a position to resist the subsequent stamping operation to obtain the resistive plates 33, which should intervene in the potentiometers, individually.

A series of advantages are derived from the described structure of the potentiometer of the invention and from the process for assembling the same, from which may be emphasised:

The parallelepiped shape of the casing enables positioning and feeding for the automatic insertion or assembly of the component in the electronic circuits.

Clamping of the terminals to the casing with shafts, perpendicular to one another, and the shape thereof, permits a higher thermal dissipation, preventing possible plastic deformations which would alter the electrical contact.

The shape itself of the clamping permits the path travelled by the electric and mechanical turn to be longer, as compared with conventional potentiometers having the same size.

The larger surface of the collector facilitates a higher thermal dissipation, guaranteeing a better operation of the component.

The bearing formed by the collector flanging guarantees a constant and uniform turning torque.

The collector flanging permits an overpressure to be applied to the rotor, simultaneously achieving a uniform turning torque, in an exact and maintained position of the cursor contacts on the resistive strip, this strip not being altered by vibrations or extraneous effects to which the component may be subjected.

The staple of the terminal surrounding the resistive strip permits an overpressure guaranteeing the electrical contact without deterioration of the resistive plate. This is due to the fact that the said pressure is applied on a solid molded surface, easy to control.

The dial of the casing enables the mechanical turning point at which the cursor is encountered, and consequently the position of the potentiometer, to be controlled.

The dual contact of the cursor on the collector and the resistive plate, since it is flexible, permits assembling irregularities, without electrical variation in the contact.

The wideness of the mouth of the casing hole facilitates entrance of the tool for automatically adjusting component.

Due to its shape and design it permits a high degree of automation in its construction process, with the consequent reduction in costs.

The shape, dimensions and materials, and in general any accessory may be varied, provided that the main feature of the described object is not altered, changed or modified.

What is claimed is:

1. A potentiometer, comoprising a parallelepiped casing formed from charged polymers having a high dielectric strength, a resistive plate housed in said casing, a rotor-actuated cursor acting on said resistive plate, two terminals and a collector, wherein said casing comprises first holes for admitting portions of the two terminals thereby to effect electrical contact between the terminals and the resistive plate, said casing further comprising externally projecting lugs of a plastically deformable material fixing the two terminals on the casing, said collector extending across one face of said casing and having arms clamped into corresponding recesses formed on adjacent faces of said casing, said casing comprising a face opposite that across which the collector extends, said opposite face comprising a dial enclosing a hole in which the rotor moves, said hole having a beveled mouth to facilitate assembly of the rotor in the casing.

2. The potentiometer according to claim 1, wherein said casing comprises a pair of plastically deformed lugs for each of the two terminals, each pair of plastically deformed lugs straddling and overlying its respective terminal.

3. The potentiometer according to claim 1, wherein said collector comprises a quadrangular portion substantially coextensive with one face of the parallelepiped casing.

4. The potentiometer according to claim 1, wherein the resistive plate comprises a resistive film comprising an agglomerated metal and ore charges, said resistive film being deposited on an electrically insulating substrate, and wherein the resistive plate has the shape of an open circular ring with flat ends and a radially inwardly extending projection in the shape of a key having rounded edges for permitting positioning of the resistive plate in the casing.

5. The potentiometer according to claim 1, wherein each of the two terminals comprises an additional portion extending into the casing through a second hole perpendicularly to the portion of the terminal establishing electrical contact with the resistive plate.

6. The potentiometer according to claim 1, wherein the two terminals have surface deformations promoting improved contact with the resistive plate.

7. The potentiometer according to claim 1, wherein the rotor-actuated cursor comprises a dual contact with rivet snaps and half round-shaped contact tiles at its diametrically oposed ends, for electrically contacting the colllector and resistive plate, respectively, and wherein said cursor and said rotor comprise cooperating interfitting projections and indentations securing the cursor to the rotor in a fixed angular position.

8. The potentiometer according to claim 1, wherein the collector comprises four stamped arms clamped to corresponding cavities in the casing, and wherein said collector further comprises a flanged central hole in sliding contact with the rotor and acting as a guide-gearing therefor, said rotor comprising three indentations resting on the flanging of the central hole of the collector, thereby to ensure regular and uniform turning torque and a stable position of the contact of the cursor on the resistive plate and the collector.

9. Process for producing a potentiometer, comprising placing a resistive plate in each of a plurality of parallelepiped casings, fitting the plurality of casings to a continuous band of stamped terminals such that portions of two terminals are received in each casing, mating the continuous band of terminals having the resistive plate-containing casings fitted thereon to a continuous array of collectors having fitted thereon a rotor and cursor corresponding to each collector, and clamping each collector of the continuous array to a corresponding casing of the continuous band.

10. The process according to claim 9, wherein the resistive plates are produced by causing a physio-chemical affinity in a first activating station between a plastic band and a resistive paint to be deposited on said plastic band, using an electric discharge on the plastic band which causes activation of functional molecular groups thereof, or by acid treatment, applying the paint immediately and continuously to the activated plastic band introduced in an instrument enabling various paints or resistive pastes to be applied simultaneously to the activated plastic band, polymerizing the applied resistive paste in a drying and curing furnace, and applying a silver glaze to the cured paste by means of a roller device, and polymerizing the applied glaze.

* * * * *

UNITED STATES PATENT AND TRADEMARK OFFICE

CERTIFICATE OF CORRECTION

PATENT NO. : 4,977,387

DATED : December 11, 1990

INVENTOR(S) : Emilio CHUECA MOLIA

It is certified that error appears in the above—identified patent and that said Letters Patent is hereby corrected as shown below:

On the title page:

In the caption of the patent, Item 19, change the inventor's surname from "Molia" to --Chueca Molia--.

In Item 75, change the inventor's name from "Emelio C. Molia" to --Emilio Chueca Molia--.

Signed and Sealed this

Seventh Day of April, 1992

*Attest:*

HARRY F. MANBECK, JR.

*Attesting Officer*

*Commissioner of Patents and Trademarks*